US007995952B2

(12) United States Patent
Pan et al.

(10) Patent No.: US 7,995,952 B2
(45) Date of Patent: Aug. 9, 2011

(54) HIGH PERFORMANCE MATERIALS AND PROCESSES FOR MANUFACTURE OF NANOSTRUCTURES FOR USE IN ELECTRON EMITTER ION AND DIRECT CHARGING DEVICES

(75) Inventors: David H. Pan, Rochester, NY (US); Fa-Gung Fan, Fairport, NY (US); Joseph A. Swift, Ontario, NY (US); Dan A. Hays, Fairport, NY (US); Michael F. Zona, Holley, NY (US)

(73) Assignee: Xerox Corporation, Norwalk, CT (US)

( * ) Notice: Subject to any disclaimer, the term of this patent is extended or adjusted under 35 U.S.C. 154(b) by 471 days.

(21) Appl. No.: 12/042,878

(22) Filed: Mar. 5, 2008

(65) Prior Publication Data

US 2009/0224679 A1 Sep. 10, 2009

(51) Int. Cl.
*G03G 21/16* (2006.01)
*H05B 39/00* (2006.01)
*G09G 3/10* (2006.01)

(52) U.S. Cl. ..... 399/168; 315/162; 315/169.1; 315/324; 315/326

(58) Field of Classification Search ..... 399/168; 315/162
See application file for complete search history.

(56) References Cited

U.S. PATENT DOCUMENTS 6,359,288 B1 * 3/2002 Ying et al. ..... 257/14
6,770,353 B1 * 8/2004 Mardilovich et al. ..... 428/209
6,885,010 B1 * 4/2005 Traynor et al. ..... 250/427
7,397,032 B2 * 7/2008 Zona et al. ..... 250/326
7,398,035 B2 * 7/2008 Zona et al. ..... 399/168
7,645,933 B2 * 1/2010 Narkis et al. ..... 136/252
2005/0127351 A1 * 6/2005 Tolt ..... 257/10
2006/0192494 A1 * 8/2006 Mastroianni ..... 315/169.1
2006/0280524 A1 * 12/2006 Hays et al. ..... 399/168
2007/0231010 A1 10/2007 Ohta et al.

FOREIGN PATENT DOCUMENTS

JP 2001066678 3/2001
JP 2001080994 3/2001
JP 2001171076 6/2001

OTHER PUBLICATIONS

Thurn-Albrecht et al., "*Ultrahigh-Density Nanowire Arrays Grown in Self-Assembled Diblock Copolymer Templates*," Science, vol. 290, pp. 2126-2129, Dec. 15, 2000.

(Continued)

*Primary Examiner* — David M Gray
*Assistant Examiner* — Francis Gray
(74) *Attorney, Agent, or Firm* — MH2 Technology Law Group LLP

(57) ABSTRACT

In accordance with the invention, there are electron emitters, charging devices, and methods of forming them. An electron emitter array can include a plurality of nanostructures, each of the plurality of nanostructures can include a first end and a second end, wherein the first end can be connected to a first electrode and the second end can be positioned to emit electrons, and wherein each of the plurality of nanostructures can be formed of one or more of oxidation resistant metals, doped metals, metal alloys, metal oxides, doped metal oxides, and ceramics. The electron emitter array can also include a second electrode in close proximity to the first electrode, wherein one or more of the plurality of nanostructures can emit electrons in a gas upon application of an electric field between the first electrode and the second electrode.

27 Claims, 7 Drawing Sheets

OTHER PUBLICATIONS

Park et al., "*Large Area Dense Nanoscale Patterning of Arbitrary Surfaces*,"Applied Physics Letters, vol. 79, No. 2, pp. 257-259, Jul. 9, 2001.

Amthor et al., "*A New Transparent Multi-Unit Recording Array System Fabricated by In-House Laboratory Technology*," Journal of Neuroscience Methods, vol. 126, pp. 209-219, 2003.

* cited by examiner

HIGH PERFORMANCE MATERIALS AND PROCESSES FOR MANUFACTURE OF NANOSTRUCTURES FOR USE IN ELECTRON EMITTER ION AND DIRECT CHARGING DEVICES

DESCRIPTION OF THE INVENTION

1. Field of the Invention

The present invention relates to electron emitters and charging devices and, more particularly, to nanostructures for use in electron emitters and charging devices and methods of forming them.

2. Background of the Invention

Exemplary devices used in conventional electrophotgraphy for photoreceptor charging include bias charging rolls (BCRs), pin scorotrons, wire corotrons, and dicorotrons. Because of the relatively large receptor surface to charger spacing distances, the non-contact type devices (corotrons, dicorotron, and scorotrons) require relatively high voltages, typically from about 3 kV to about 7 kV, to establish the electric fields needed to charge the photoreceptor surface to the desired potential and uniformity. In the case of these non-contact devices, charging is performed through the interaction of the electric field and gas to create a corona plasma (corona). Ions of the desired polarity migrate towards and are then deposited upon the photoreceptor. Furthermore, these non-contact, high voltage charging devices create undesirable byproducts, such as, ozone, nitrogen oxides ($NO_X$), and $NO_X$-related acids. As a result, these devices consume more energy than is minimally necessary because the present designs require and consume additional energy to produce the undesirable byproducts. Hence, there is a need for reducing energy demand by these devices if a larger portion of the energy used can be converted to useful work. In addition, printers employing these devices traditionally use filters and engineered gas flows to counter the adverse effects of the effluents further consuming energy and space within the printer that may be saved if the efficiency of the charging devices could be improved. These ancillary filters and gas flow contribute to higher than necessary manufacturing, run, and service costs. In contrast, BCRs operate at somewhat lower voltages, typically from about 1 kV to about 5 kV, because they are generally used in direct contact with the photoreceptor surface. BCRs employ a combination of direct-contact charging and ionized gas to charge the photoreceptor and therefore tend to be somewhat more efficient and generate somewhat less effluents. However, since BCRs make a footprint on the receptor's surface and are mechanically coupled thereto and co-rotate therewith, BCRs are known to cause other undesired problems related to high photoreceptor wear, contamination, and filming. Thus, there is a need for new charging devices that avoid these problems while enabling more efficient, cleaner operation, and are smaller, more compact in size than conventional devices.

Accordingly, there is a need to overcome these and other problems of prior art to provide electron emitters and charging devices and methods of forming them.

SUMMARY OF THE INVENTION

In accordance with various embodiments, there is an electron emitter array including a plurality of nanostructures; each of the plurality of nanostructures including a first end and a second end, wherein the first end can be connected to a first electrode and the second end can be positioned to emit electrons, and wherein each of the plurality of nanostructures can be formed of one or more of oxidation resistant metals, doped metals, metal alloys, metal oxides, doped metal oxides, and ceramics The electron emitter array can also include a second electrode in close proximity to the first electrode, wherein one or more of the plurality of nanostructures can emit electrons in a gas upon application of an electric field between the first electrode and the second electrode.

According to various embodiments, there is also a charging device. The charging device can include a plurality of nanostructures, each of the plurality of nanostructures including a first end and a second end, wherein the first end can be connected to a first electrode and the second end can be positioned to emit electrons, and wherein each of the plurality of nanostructures can be formed of one or more of oxidation resistant metals, doped metals, metal alloys, metal oxides, doped metal oxides, and ceramics. The charging device can also include a second electrode separated from the first electrode by a gap, wherein the first electrode and the second electrode can be disposed in an environment including a gas. The charging device can further include a receptor positioned adjacent to the gap separating the first electrode and the second electrode, an aperture electrode in close proximity to the gap separating the first electrode and the second electrode and positioned in between the receptor and the first electrode and the second electrode, a first power supply to apply a voltage between the first electrode and the second electrode, and a second power supply to apply voltage between the aperture electrode and the receptor.

According to another embodiment, there is a method of charging a receptor in a charging device. The method can include forming a plurality of nanostructures of one or more of oxidation resistant metals, doped metals, metal oxides, doped metal oxides, metal alloys, and ceramics over a first electrode, wherein each of the plurality of nanostructures comprises a first end and a second end, the first end being connected to a first electrode and the second end positioned to emit electrons. The method can also include providing a second electrode in close proximity to the first electrode and applying a voltage between the first electrode and the second electrode, wherein a threshold electric field for electron emission is less than about 5.5 V/μm. The method can further include supplying a gaseous material between the first electrode and the second electrode, such that an electric field on the plurality of nanostructures ionizes a portion of the gaseous material, and directing the ionized gaseous material towards a receptor.

According to yet another embodiment, there is a charging device including a plurality of nanostructures, each of the plurality of nanostructures including a first end and a second end, wherein the first end can be connected to a first electrode and the second end positioned to emit electrons, and wherein each of the plurality of nanostructures can be formed of one or more of oxidation resistant metals, including doped metals, doped metal oxides, metal alloys, metal oxides, and ceramics. The charging device can also include a receptor positioned in close proximity to the first electrode, the receptor having a ground plane, and a first power supply to apply a voltage between the first electrode and the receptor to enable generation of a plurality of charged species in a gas that can be deposited on the receptor.

Additional advantages of the embodiments will be set forth in part in the description which follows, and in part will be obvious from the description, or may be learned by practice of the invention. The advantages will be realized and attained by means of the elements and combinations particularly pointed out in the appended claims.

It is to be understood that both the foregoing general description and the following detailed description are exemplary and explanatory only and are not restrictive of the invention, as claimed.

The accompanying drawings, which are incorporated in and constitute a part of this specification, illustrate embodiments of the invention and together with the description, serve to explain the principles of the invention.

BRIEF DESCRIPTION OF THE DRAWINGS

FIGS. 5A and 5B illustrate exemplary electrophotographic charging devices, according to various embodiments of the present teachings.

DESCRIPTION OF THE EMBODIMENTS

Figure 1A:
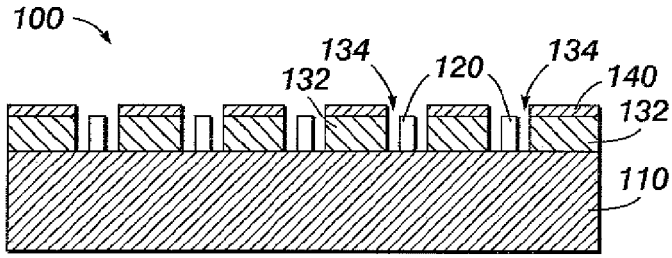
FIG. 1A illustrates an exemplary electron emitter array, according to various embodiments of the present teachings.

Reference will now be made in detail to the present embodiments, examples of which are illustrated in the accompanying drawings. Wherever possible, the same reference numbers will be used throughout the drawings to refer to the same or like parts.

Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviation found in their respective testing measurements. Moreover, all ranges disclosed herein are to be understood to encompass any and all sub-ranges subsumed therein. For example, a range of "less than 10" can include any and all sub-ranges between (and including) the minimum value of zero and the maximum value of 10, that is, any and all sub-ranges having a minimum value of equal to or greater than zero and a maximum value of equal to or less than 10, e.g., 1 to 5. In certain cases, the numerical values as stated for the parameter can take on negative values. In this case, the example value of range stated as "less that 10" can assume negative values, e.g. −1, −1.2, −1.89, −2, −2.5, −3, −10, −20, −30, etc.

As used herein, the term "electron emission" is used to describe the movement of electrons from the solid state material of the nanostructured electrode into the surrounding gaseous space under application of an electric field. As used herein, the term "electron emitter" refers to the nanostructured electrode including, but not limited to, its constituent material(s) and design. Owing to the fact that in a practical commercial charging device, which must function in the open environment, electron emission can lead to and can simultaneously occur with corona, or micro-corona phenomena. Thus, the term "electron emission" is used herein in the broader sense and includes onset of field driven electron emission as well as sustentation of emission current and micro-corona/corona phenomena.

In classical physics, the term work function is used to indicate the efficiency or level of barrier by which solid state materials under conditions of an electrostatic field and in vacuum can move electrons from within the solid into a gap. In the context of the present invention where the subject electron emitters must function in open environment, we define a new term "effective work function" to represent the efficiency whereby electrons move from the solid ends of the emitters under electrostatic fields and in a gas into the space between the emitter ends and a counter electrode. The term oxidation resistant material is used throughout this specification and is intended to refer to the behavior of the electron emitters that must function in the open environment, which may often represent a contaminated ambient environment, for long periods of time without significant loss of function due to deleterious chemical interactions with said environment. Generally, the chemical reaction of base metals with environmental oxygen or ozone results in oxidation of the metal and typically may alter the electron emission characteristics and specifically the effective work function of the emitting element. Often, an indication that the emission performance is being adversely impacted by oxidization of the emitter element is the observation of an increase in the level of field required to initiate electron emission. A secondary indicator of loss of emitter performance is reduction of the aggregate output current as a function of operating time. Although oxidation resistant materials with high electron emission efficiency represents a particularly desirable characteristic, the broader objective for the present invention is to provide robust electron emitter and corona tolerant materials that withstand long periods of use in open environments without significant or adverse loss of function.

Figure 1B:
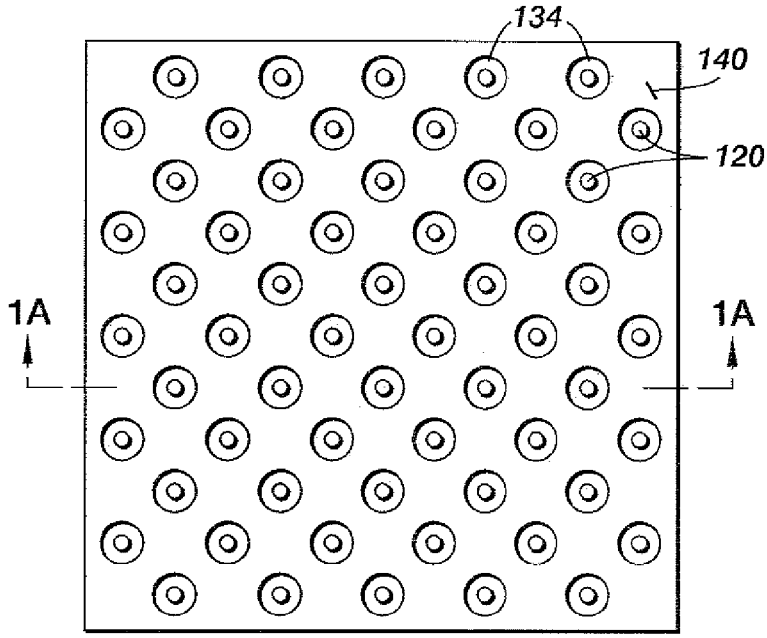
FIG. 1B illustrates a top view of the exemplary electrode of the electron emitter array shown in FIG. 1A, according to various embodiments of the present teachings.
Figure 1C:
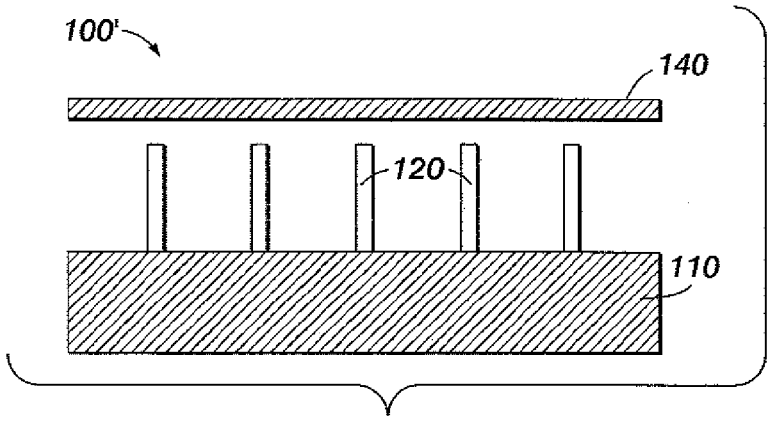
FIG. 1C illustrates another exemplary electron emitter array, according to various embodiments of the present teachings.
Figure 1D:
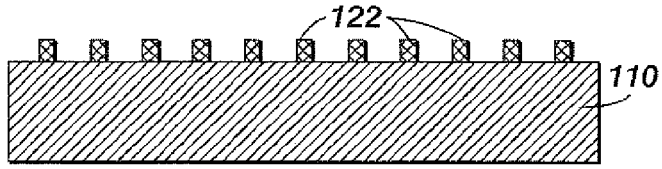
FIGS. 1D-1F illustrate exemplary nanostructures of an electron emitter array, according to various embodiments of the present teachings.
Figure 1E:
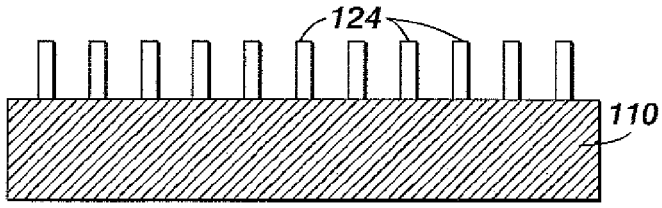
Figure 1F:
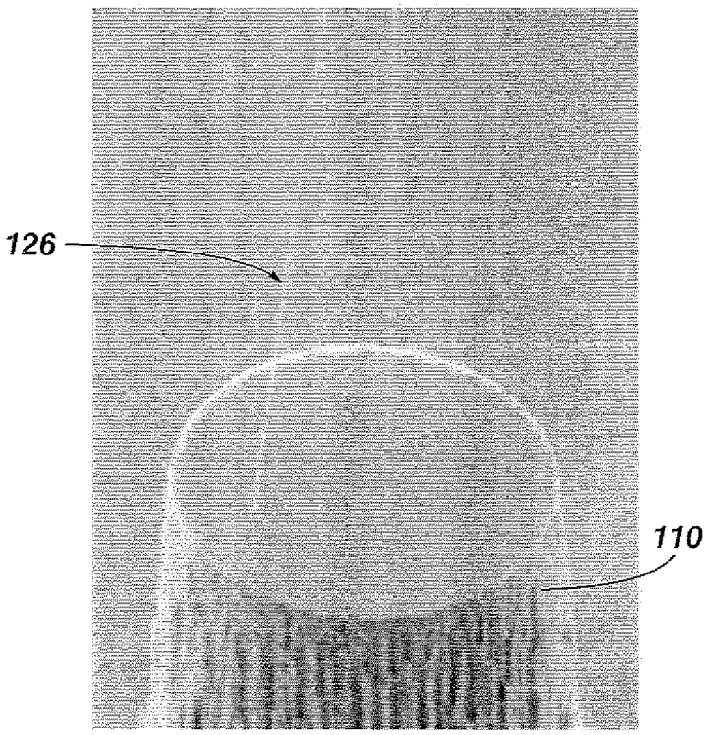

FIG. 1A illustrates an exemplary electron emitter array 100, according to various embodiments of the present teachings. The exemplary electron emitter array 100 can include a plurality of nanostructures 120, each of the plurality of nanostructures 120 can include a first end and a second end, wherein the first end can be connected to a first electrode 110 and the second end can be positioned to emit electrons, and wherein each of the plurality of nanostructures 120 can be formed of one or more of oxidation resistant metals, including transition as well as noble metals, doped metals, metal alloys, metal oxides, doped metal oxides, and ceramics as well as mixtures, blends, and alloys thereof In various embodiments, the nanostructures 120 can be electrically conductive. In other embodiments, the nanostructures 120 can be semi-conductive. Yet, in some other embodiments, the nanostructures 120 can be resistive or semi-resistive. In some embodiments, the nanostructures 120 can be oriented to be essentially perpendicular to the electrode 110 as illustrated in FIGS. 1A and 1C. In other embodiments, the nanostructures can be oriented at any angle to the electrode 110 as illustrated by nanostructure 126 in FIG. 1F. In some other embodiments, the nanostructures 120 can be oriented to lay flat (not shown) along the electrode 110. The electron emitter array 100 can also include a second electrode 140 in close proximity to the first electrode 110, such that an electric field created between the first electrode and the second electrode can be sufficient to enable one or more of the plurality of nanostructures 120 to emit electrons in a gas. In various embodiments, the electron emitter array 100 can have a threshold electric field for electron emission of less than about 5.5 V/μm, and in some cases less than about 3.5 V/μm. In other embodiments, the threshold electric field for electron emission can be from about less than 0.5 V/μm to about 2.0 V/μm, which can be about 3 to more than 10 times as efficient as a conventional device such as pin scorotron, corotron, dicorotron, and the like, having a threshold electric field from about 6 V/μm to about 8 V/μm and in some cases greater than 8 V/μm. In certain embodiments, the threshold electric field for electron emission can be from less than or equal to 0.5 V/μm. In various embodiments, the plurality of nanostructures 120 can include one or more of a plurality of nanodots 122 as shown in FIG. 1D, a plurality of nanotubes 124 as shown in FIG. 1E, a plurality of nanocones (not shown), a plurality of nanowires 126 as shown in FIG. 1F, and a plurality of nanofibers (not shown). In some embodiments, the electron emitter array 100 can also include a polymer layer 132 over portions of the first electrode 110, such that the plurality of nanostructures 120 can be disposed within or adjacent to the polymer layer 132 with an insulating gap, space, or region 134 around each of the plurality of nanostructures 120, as shown in FIGS. 1A and 1B. In some embodiments, the insulating gap 134 around each of the plurality of nanostructures 120 can be filled with a gas or other suitable fluid. In other embodiments, the space or region 134 around each of the plurality of nanostructures 120 can be filled with a suitable polymer, including a suitable thermoplastic or thermosetting polymer. In various embodiments, the second electrode 140 can be disposed over the polymer layer 132 as shown in FIGS. 1A and 1B. FIG. 1C illustrates another exemplary electron emitter array 100', according to various embodiments of the present teachings. The electron emitter array 100', as shown in FIG. 1C, can include a plurality of nanostructures 120 disposed over a first electrode 110 and a second electrode 140 disposed in close proximity to the first electrode 110.

In various embodiments, the substrates for the first electrode 110 and the second electrode 140 can be made from any suitable conductive material, such as, for example, metals, doped metals, such as antimony doped silicon, metal alloys, metal oxides such as indium tin oxide coated on glass, doped metal oxides such as aluminum doped zinc oxide, organometallics, and conductive organic composite materials. In some embodiments, each of the plurality of nanostructures 120 can be formed of one or more of oxidation resistant metals, wherein the oxidation resistant metal, doped metal, and metal alloy can include one or more elements from Groups 3, 4, 5, 6, 7, 8, 9, 10, 11, 12, 13, and 14 of the periodic table. In other embodiments, each of the plurality of nanostructures 120 can be formed of one or more of metal oxide and doped metal oxide selected from the group consisting of iron oxide, copper oxide, aluminum oxide, tin oxide, indium tin oxide, zinc oxide, tungsten oxide and chromium, copper, gold, palladium, platinum, nickel, cobalt, or chromium doped iron oxide, copper oxide, aluminum oxide, tin oxide, indium tin oxide, zinc oxide, tungsten oxide, and any transition metal doped oxide including, for example, manganese or vanadium doped zinc oxide, aluminum doped zinc oxide, and the like. In some other embodiments, each of the plurality of nanostructures 120 can be formed of one or more of oxidation resistant ceramics, wherein the ceramic can be selected from the group consisting of an electrically conductive, semiconductive, resistive, or semi-resistive, such as, for example, alumina, barium titanate, calcium titanate, magnesium titanate as well as some of the transition metal oxides that are semiconductors, such as zinc oxide. In certain embodiments, the nanostructures 120 can be formed from a cermet which is a composite material made from metal and ceramic.

As noted earlier, the term "oxidation resistant" is used herein to refer to the tendency of a material to avoid or resist reacting chemically with, or otherwise combining with oxygen in such a manner to adversely affect the physical, mechanical, electrical, or other functional properties or performance characteristics during the operational life of a device made employing said material. In similar context, the term "corrosion resistant" is used herein to refer to a capability of a material to resist weakening, wear, erosion, or other deleterious effect by the action of chemicals by exposure, for example, to environmental dust, particles, or gasses such as salt spray, sulfur dioxide ($SO_2$), nitrogen oxides ($NO_x$), moisture, and the like. The terms "oxidation resistant" and "corrosion resistant" are used throughout this document and refer in general to the desired ability of the subject material used within a device to sustain optimum, stable operability over a projected operational life and without loss or effect to function due to chemical or physical contamination or interaction.

In various embodiments, each of the plurality of nanostructures 120 can further include one or more barrier layer coatings (not shown) over at least a portion of each of the plurality of nanostructures 120 to improve the overall oxidation and/or corrosion resistance of the electron emitter arrays 100, 100'. In various embodiments, the barrier layer coating can be formed of any suitable material that, for example has low or very low moisture, oxygen, or ozone diffusivities and can be applied in a continuous layer over each of the plurality of nanostructures 120 without adversely impacting the operational features of the electron emitter array 100, 100'. In some embodiments, the barrier layer coating can have a thickness less than about 100 nm. Exemplary barrier layer coatings can include, but is not limited to polytetrafluoroethylene (PTFE), polyglycidyl methacrylate (PGMA), polyvinylchloride, polyimide, epoxy, polyethersulphone, polyetheretherketone, polyetherimide, and polymethylmethacrylate (PMMA). The barrier layer can be dense and homogeneous or alternately can be microscopically porous and can have features such as pore size, density, and distribution that are selected to serve to allow the efficient passage of electrons while serving as a filter to prevent particulate matter, such as dust, ash, pollen, smoke, toner particles, and the like from coming into direct contact with the nanostructures 120. The barrier layer coating can be deposited over each of the plurality of nanostructures 120 by any suitable method, such as, for example, heat and/or pressure lamination, solvent coating, solvent spraying, or low temperature, gas vapor deposition processes known to a person of ordinary skill in the art, for example, GVD Corporation (Cambridge, Mass.). In some embodiments, barrier layer coatings can include solution coated polyvinylidene-fluoride and chloride (PVDF and PVDC). In other embodiments, barrier layer coating can include vapor phase deposited silica. One of ordinary skill in the art would know that one can employ first principle based (ab initio) quantum chemistry simulation methods to identify appropriate materials for the nanostructure 120 and/or the barrier layer coating to resist against oxidation and other corrosives or contaminants such as $NO_x$, $SO_2$, and ozone. These methods look into the detailed electronic structure and interactions between the gas molecules and the nanostructure 120 and/or the barrier layer coating and therefore can provide valuable information and guidance in the materials selection and device design processes.

In various embodiments, the plurality of nanostructures 120, can include a plurality of barrier layer coated nanotubes (BL-NT), for example carbon nanotubes (BL-CNT) or boron nitride nanotubes (BL-BNT), and the like, wherein each of the plurality of barrier layer coated nanotubes (BL-NT) can include a carbon nanotube (CNT) and/or a boron nitride nanotube (BNT) having one or more barrier layer coatings over at least a portion of it. In some embodiments, a portion of the nanostructure 120, for example, the external surfaces along the sidewalls can be covered with at least one coating, and a different portion of the nanostructure 120, for example the tip-most region can be covered with at least one other coating. The barrier layer coatings over the nanostructure 120 can prevent oxidation when used in the open environment under current densities in the region of about $10^{-7}$ to about $10^{-9}$ A/cm$^2$ or higher. BL-CNTs can also have long functional lives under higher current density conditions required for photoreceptor charging, as compared to conventional CNT. BL-CNTs can be formed by first growing carbon nanotubes by any suitable process, followed by deposition of one or more barrier layer coatings over each of the carbon nanotubes. Conventional carbon nanotubes can be grown by a high temperature (e.g. >500-700° C.) process where a carbon source gas (for example, acetylene) reacts with a suitable catalyst (for example, iron-aluminum, iron-titanium, and cobalt titanium) that is coated onto a suitable substrate. Since the process employs high temperature, the selection of substrates that can be used in this process is limited to such materials as, glass, silicon wafers, metal, and the like.

Figure 2:
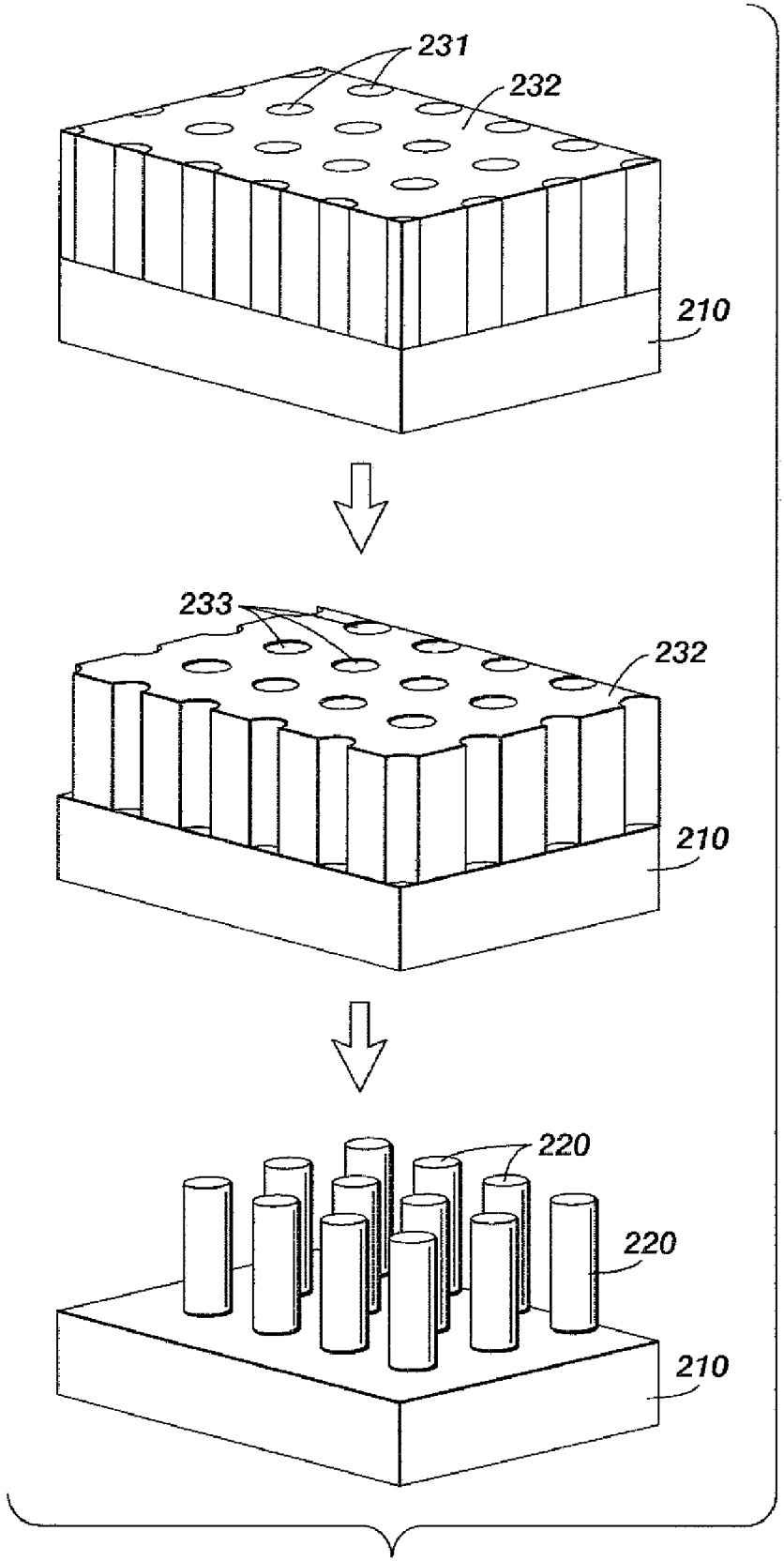
FIG. 2 illustrates an exemplary method of making nanostructures by a polymer template method.

In various embodiments, the plurality of nanostructures 120 can be formed by one or more of a polymer template method, self assembly of nanoparticles, arc discharge, pulsed laser deposition, chemical vapor deposition, electrodeposition, and electroless deposition. In various embodiments, each of the plurality of nanostructures 120 can have a diameter less than about 500 nm. FIG. 2 illustrates an exemplary method of making nanostructures by two step polymer template method. The two step polymer template method can include a first step of preparing a thin polymer film 232 with regular array of cylindrical nanochannels 233 and a second step of filling these nanochannels 233 with one or more of oxidation resistant metals, doped metals, metal alloys, metal oxides, doped metal oxides, and ceramics to fabricate nanostructures 220 including one or more of nanotubes, nanodots, nanocones, nanowires, and nanofibers. The thin polymer membrane 232 can be fabricated based on the phenomenon of self-organization of block copolymers in thin films.

An exemplary method of fabrication of the plurality of nanostructures 120 can include forming a 1,4-dioxane solution of polystyrene-block-poly(4-vinylpyridine) (PS-PVP) and 2-(4'-hydroxybenzeneazo)benzoic acid (HABA) at the stoichiometric ratio (one 4-vinylpyridine unit to one HABA molecule). HABA molecules can then selectively attach to 4-vinylpyridine units of the PVP block by hydrogen bonds forming a supramolecular assembly (denoted below PS-PvP+HABA. A thin polymer film 232 of PS-PvP+HABA, having a thickness of about 20 nm to about 200 nm can be formed over the first electrode 210 either by spin-coating or dip-coating. The thin polymer film 232 can then be placed in a saturated atmosphere of 1,4-dioxane vapor and allowed to swell to the swelling ratios of about 2.5 to about 3.0 to promote the ordering of the PS-PvP+HABA assembly. The PS-PvP+HABA assembly can form a well-ordered hexagonal structure of PVP+HABA cylinders in the PS matrix. The PVP+HABA cylinders can be oriented perpendicular to the confining interfaces and form a "vertical columnar array," as shown for example by 231 in FIG. 2. HABA can then be selectively extracted from the PVP+HABA cylinders by rinsing in methanol, thereby transforming the cylinders into nanochannels 233, as shown in FIG. 2. In some embodiments, the diameter of the nanochannels 233 can be about 8 nm and the inter-nanochannel distance can be about 24-25 nm. In the next step, the thin polymer film 232 can be used as a template for the growth of nanostructures 220. In some embodiments, nickel, copper, gold, or palladium can be electrochemically deposited into the nanochannels 233 of the thin polymer film 232 on a gold electrode 210. In other embodiments, the nanochannels 233 can be filled by sputtering chromium, gold, or any suitable metal.

Another suitable method to form the plurality of nanostructures 120 can use a diblock copolymer/homopolymer blend as the low density nanolithographic mask, such as, for example, A/B diblock copolymer/A homopolymer blend. The addition of a homopolymer (A) to an AB diblock copolymer can increase the distance between the nanophase separated B sphere domains, thereby lowering the density of the B domains. A nanofabrication approach using only diblock copolymer is disclosed in, "Large area dense nanoscale patterning of arbitrary surfaces", Park, M.; Chaikin, P. M.; Register, R. A.; Adamson, D. H. *Appl. Phys. Lett.,* 2001, 79(2), 257, which is incorporated by reference herein in its entirety. Exemplary diblock copolymers can include, but are not limited to polystyrene/polyimide block copolymer, polystyrene-block-polybutadiene, poly(styrene)-b-poly(ethylene oxide), and the like. While, polystyrene/polyimide diblock copolymer can produce an ordered array of nanocylinders with a constant nanocylinder-to-nanocylinder distance, the polystyrene-polystyrene/polyimide blend can be expected to produce an array of nanocylinders dispersed statistically, rather than regularly. However, this is acceptable for the electron emitter array application because, in practice there is a very large number of emitters available in the array and not every individual electron emitter is required to be fully operational in order to yield a commercially viable device. The resulting array using the polystyrene-polystyrene/polyimide blend can have an area density in the range of about 10 to about $10^9$ cylinders/cm$^2$.

Figure 3A:
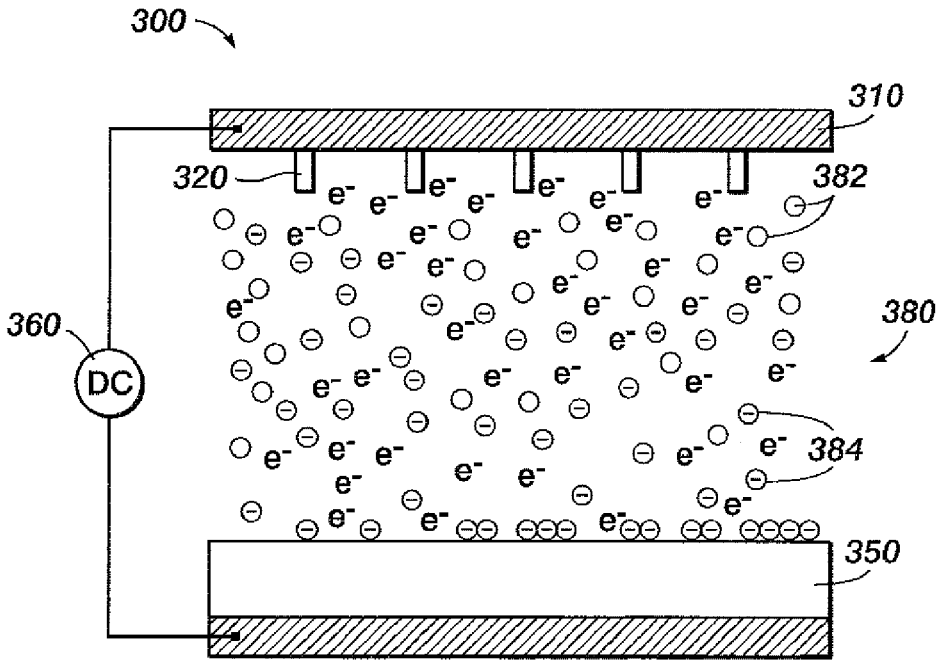
FIGS. 3A and 3B illustrate exemplary electrophotographic charging devices, according to various embodiments of the present teachings.
Figure 3B:
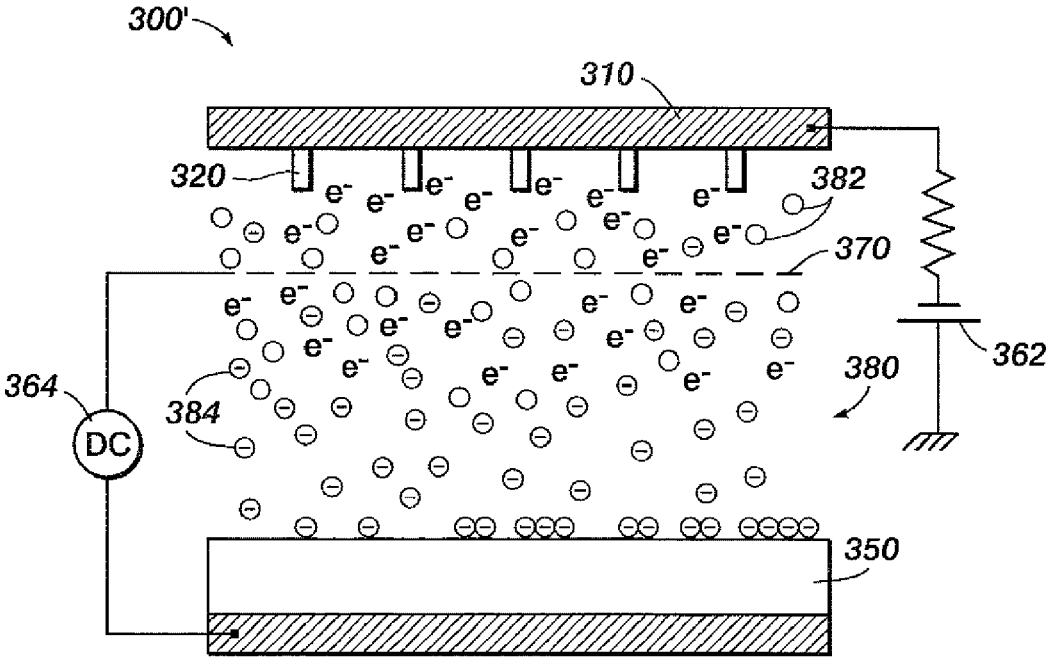
Figure 4A:
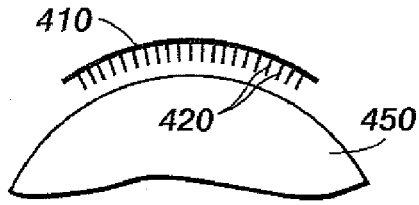
FIGS. 4A-4D illustrate exemplary electrophotographic charging devices, according to various embodiments of the present teachings.
Figure 4B:
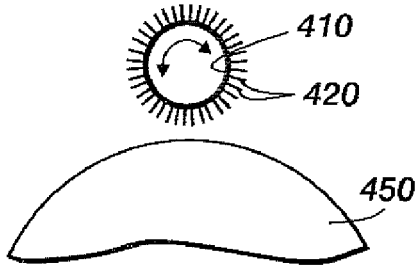
Figure 4C:
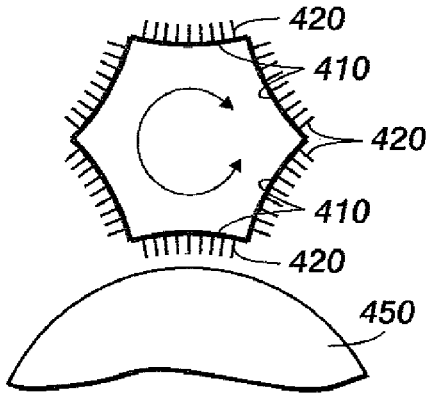
Figure 4D:
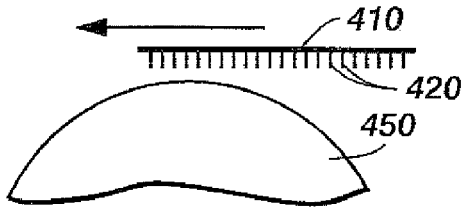

FIGS. 3A and 3B illustrate exemplary electrophotographic charging devices 300, 300' according to various embodiments of the present teachings. The charging device 300, 300' can include a plurality of nanostructures 320, each of the plurality of nanostructures 320 including a first end and a second end, wherein the first end can be connected to a first electrode 310 and the second end can be positioned to emit electrons, and wherein each of the plurality of nanostructures 320 can be formed of one or more of oxidation resistant metals, doped metals, metal alloys, metal oxides, doped metal oxides, and ceramics. In various embodiments, the plurality of nanostructures 320 can have an area density of less than about $10^9$ cylinders/cm$^2$. In some embodiments, at least a portion of each of the plurality of nanostructures 320 can be coated with or encased in a suitable barrier coating (not shown). In other embodiments, a portion of each of the plurality of nanostructures 320, for example, the external surfaces along the sidewalls can be covered with at least one coating, and a different portion of each of the plurality of nanostructures 320, for example, the tip-most region can be covered with at least one other coating. The charging device 300, 300' can also include a receptor 350 positioned in close proximity to the first electrode 310, the receptor 350 having a suitable conductive backing layer which may also serve as a ground plane. The charging device 300, 300' can further include a first power supply 360 to apply a voltage between the first electrode 310 and the receptor 350 to enable generation of a plurality of charged species 384 in a gas that can be deposited on the receptor 350, as shown in FIG. 3A in various embodiments, the charging device 300' can further include a grid electrode 370 disposed between the first electrode 310 and the receptor 350 and a second power supply 364 to apply a voltage between the grid electrode 370 and the receptor 350, as shown in FIG. 3B. In some embodiments, a negative DC bias can be applied to the first electrode 310 to cause an electron field emission from the nanostructures 320. In various embodiments, a threshold electric field for electron emission can be less than about 3.5 V/μm. In some embodiments, the threshold electric field for electron emission can be from about 0.5 V/μm to about 2.0V/μm. The emitted electrons in the charging zone 380 can cause the gas molecule 382 to acquire a negative charge to form negatively changed species 384, as shown in FIGS. 3A and 3B. In some embodiments, a second negative DC bias can be applied to the grid electrode 370 to establish an electric field between the grid electrode 370 and the receptor 350. When the surface potential of the receptor 350 becomes comparable to the negative DC bias applied to the grid electrode 370, the charging on the receptor 350 ceases. In other embodiments, the gap between the first electrode 310 and the grid electrode 370 can be pre-determined for preferred levels of electron emission and gas molecule ionization. In various embodiments, the charging device 300, 300' can have a width from about 0.1 mm to about 100 mm in the process direction where the selection of width may take under consideration the velocity of the receptor moving across the charging device and the desired level of surface potential and uniformity upon the receptor. In various embodiments, multiple first electrodes 310 can be appropriately configured to form the charging zone 380. In certain embodiments, multiple, closely spaced charged zones 380 can be arranged in the process direction to allow high process speed charging of the receptor 350. FIGS. 4A-4D illustrate exemplary electrophotographic charging devices, according to various embodiments of the present teachings, including a plurality of nanostructures 420 disposed over a first electrode 410 and a receptor 450 in close proximity to the first electrode 410. Since the adhesion of the nanostructures 420 to the substrate 410 is a factor determining robustness of the electrophotographic charging device, a high level of adhesion is necessary and is generally specified to be a substantial fraction of the breaking strength of the nanostructure, for example about 50 to about 100%. Thus, adhesive failure between the nanostructure 420 and the substrate 410 can occur only at a level close to or equal to the breakage point of the nanostructure 420. Naturally, barrier coatings can be used to not only affect oxidation and or corrosion characteristics of the nanostructures 420 in an array but can be used to improve the relative adhesion and breaking strengths of the nanostructures 420 in the array.

Figure 5B:
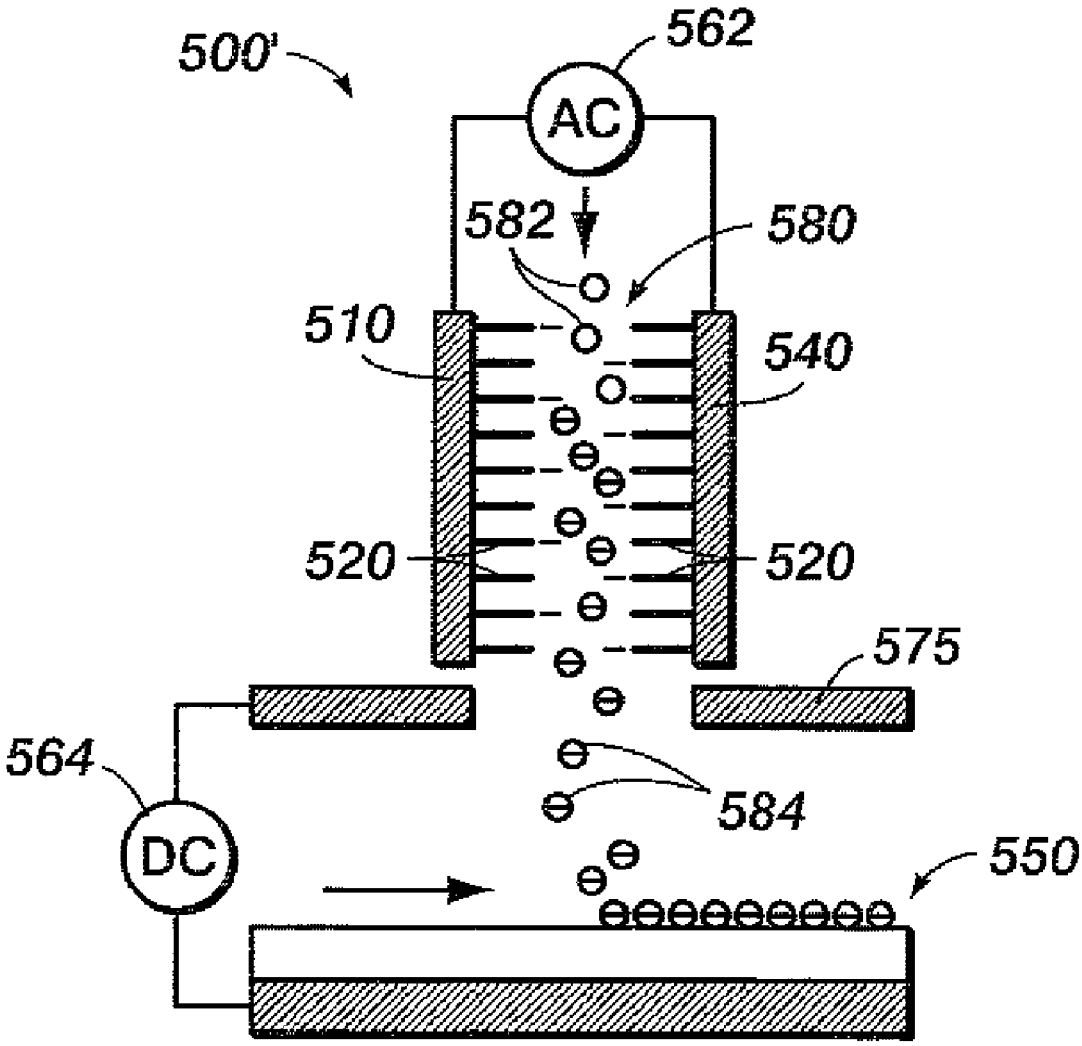

FIGS. 5A and 5B illustrate exemplary electrophotographic charging devices 500, 500', according to various embodiments of the present teachings. The charging device 500, 500' can include a plurality of nanostructures 520, each of the plurality of nanostructures including a first end and a second end, wherein the first end can be connected to a first electrode 510 and the second end can be positioned to emit electrons, and wherein each of the plurality of nanostructures 520 can be formed of one or more of oxidation resistant metals, doped metals, metal alloys, metal oxides, doped metal oxides, and ceramics. In some embodiments, at least a portion of each of the plurality of nanostructures 520 can be coated with or encased in a suitable barrier coating (not shown). In other embodiments, a portion of each of the plurality of nanostructures 520, for example, the external surfaces along the sidewalls can be covered with at least one coating, and a different portion of each of the plurality of nanostructures 520, for example the tip-most region can be covered with at least one other coating. The charging device 500, 500' can also include a second electrode 540 separated from the first electrode 510 by a gap, wherein the first electrode 510 and the second electrode 540 can be disposed in an environment including a gas. The charging device 500, 500' can further include a receptor 550 positioned adjacent to the gap separating the first electrode 510 and the second electrode 540 and an aperture electrode 575 in close proximity to the gap separating the first electrode 510 and the second electrode 540 and positioned in between the receptor 550 and the first electrode 510 and the second electrode 540. In some embodiments, the distance between the edge of the first electrode 510 and the receptor 550 can be less than about 10 mm. In other embodiments, the distance between the first electrode 510 and the second electrode 540 can be from about 0.01 mm to about 5 mm and can be selected to be a ratio of the length of the nanostructures 520 in the array, for example, about 2 times to about 10 times the nanostructures' 520 length or height. The charging device 500, 500' can also include a first power supply 562 to apply a voltage between the first electrode 510 and the second electrode 540 and a second power supply 564 to apply voltage between the aperture electrode 575 and the receptor 550. In various embodiments, a threshold electric field for electron emission can be less than about 5.5 V/μm and in some cases less than about 3.5 V/μm. In other embodiments, the threshold electric field for electron emission can be from about less than 0.5 V/μm to about 2.0 V/μm. In various embodiments, the charging device 500, 500' can further include a gas unit (not shown) to supply a gaseous material 582 between the first electrode 510 and the second electrode 540. In some embodiments, a negative DC bias can be applied to the first electrode 510 to cause an electron field emission from the nanostructures 520, as shown in FIG. 5A. The emitted electrons in the charging zone 580 can cause the gas molecule 582 to acquire a negative charge to form negatively changed species 584, as shown in FIG. 5A. In some embodiments, a second negative DC bias can be applied to the grid electrode 570 to establish an electric field between the grid electrode 570 and the receptor 550 and thereby serve to move and focus the charged molecules 584 onto the surface of the receptor.

In some embodiments, the charging device 500' as shown in FIG. 5B can further include a plurality of nanostructures 520 disposed over the second electrode 540, such that each of the plurality of nanostructures 520 can include a first end and a second end, wherein the first end can be connected to the second electrode and the second end is positioned to emit electrons, and wherein each of the plurality of nanostructures 520 can be formed of one or more of oxidation resistant metals, doped metals, metal alloys, metal oxides, doped metal oxides, and ceramics. In other embodiments, the charging device 500' as shown in FIG. 5B can also include a first power supply 562 to apply an AC voltage or an AC voltage having a DC offset between the first electrode 510 and the second electrode 540. In various embodiments, a square wave AC voltage or a modified square wave voltage can be applied between the first electrode 510 and the second electrode 540. Alternatively, a series of voltage pulses can be used instead of the steady DC voltage during each half cycle. During the half AC cycle, when one of the electrodes 510, 540 can be at a negative potential and the other electrode 540, 510 can be at a positive potential, electrons can be field emitted into the charging zone 580 from the nanostructures on the negatively charged electrode 510, 540. During the next half cycle, the roles of the electrodes 510, 540 can be reversed. In this way, the gaseous material 582 flowing through the charging zone 580 can be alternately subjected to electrons from each of the electrodes 510, 540.

Figure 6:
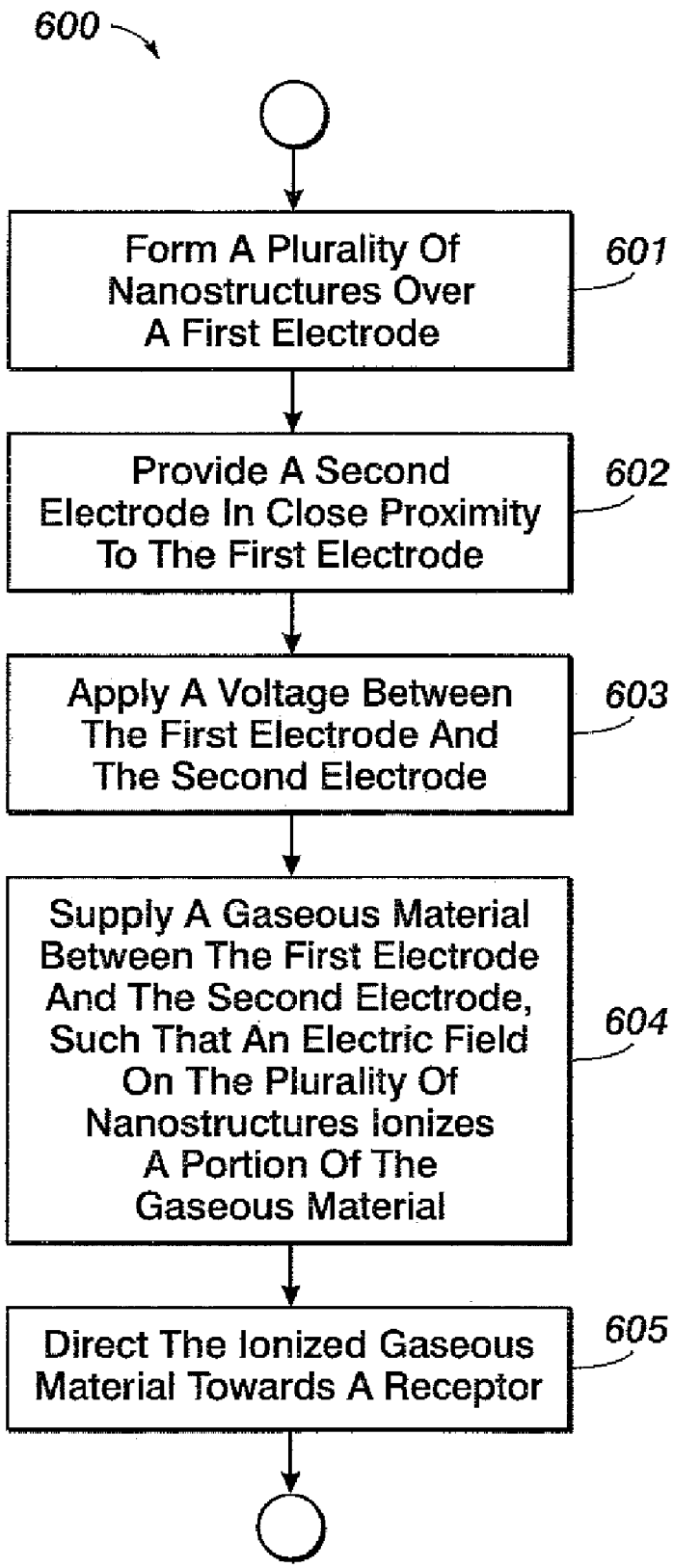
FIG. 6 shows an exemplary method of charging a receptor in an electrophotographic charging devices according to various embodiments of the present teachings.

According to various embodiments, there is a method of charging a receptor 350, 550 in a charging device 300, 300', 500, 500', as shown in FIG. 6. The method can include forming a plurality of nanostructures 320, 520 of one or more of oxidation resistant metals, doped metals, metal oxides, doped metal oxides, metal alloys, and ceramics over a first electrode 310, 510, as shown in step 601, wherein each of the plurality of nanostructures 320, 520 can include a first end and a second end, the first end being connected to a first electrode 310 and the second end positioned to emit electrons. In various embodiments, the step 601 of forming a plurality of nanostructures 310, 510 can include forming one or more of a plurality of nanotubes, a plurality of nanodots, a plurality of nanocones, a plurality of nanowires, and a plurality of nanofibers. In some embodiments, the step 601 of forming a plurality of nanostructures 320, 520 can include forming the plurality of nanostructures 320, 520 by one or more of one or more of a polymer template method, self assembly of nanoparticles, arc discharge, pulsed laser deposition, chemical vapor deposition, electrodeposition, and electroless deposition. The method can also include providing a second electrode 540, in close proximity to the first electrode 510, as in step 602 and applying a voltage between the first electrode 510 and the second electrode 540, as in step 603, wherein a threshold electric field for electron emission can be less than about 5.5V/μm. In some embodiments, the step 602 of providing a second electrode can include providing a receptor 350, as shown in FIGS. 3A and 3B. The method can further include supplying a gaseous material between the first electrode and the second electrode, such that an electric field on the plurality of nanostructures 320, 520 ionizes at least a portion of the gaseous material, as in step 604 and directing the ionized gaseous material towards a receptor 350, 550, as in step 605. In some embodiments, a suitable barrier layer coating can be applied onto and/or between the nanostructures 320, 520 of the array. The gaseous material can be any suitable gas, such as, for example, nitrogen, argon, hydrogen, oxygen, nitrogen oxides (i.e. $NO_X$), carbon dioxide, carbon monoxide, mixtures thereof, as well as dry and moist gas.

While the invention has been illustrated respect to one or more implementations, alterations and/or modifications can be made to the illustrated examples without departing from the spirit and scope of the appended claims. In general, the material and process parameters that determine the level of electron emission from a nanostructured emitter source (particularly in vacuum) are known to those skilled in the art. The factors that underpin electron emission in a gas are less well known. Nonetheless, consideration must be given to factors and to the interaction amongst factors, such as; level of applied field, size and shape of the emitting element, placement pattern within the electrode array, fill density, effective work function, barrier coating type, placement and amount, gas type, source and flow rate, emitter material type and to size, material, shape, and surface properties of the counter electrode in order to achieve consistent and high levels of output emission current. Since the emitter must function reliably in an open environment, careful consideration must also be given to selection of the precise oxidization resistant material which may represent the best operational option taking into consideration all of the above mentioned factors, plus cost and manufacturability. Clearly, there is likely to be more than one combination of materials and design that can fulfill the totality of requirements imposed on a commercially viable device. In addition, while a particular feature of the invention may have been disclosed with respect to only one of several implementations, such feature may be combined with one or more other features of the other implementations as may be desired and advantageous for any given or particular function. Furthermore, to the extent that the terms "including", "includes", "having", "has", "with", or variants thereof are used in either the detailed description and the claims, such terms are intended to be inclusive in a manner similar to the term "comprising." As used herein, the phrase "one or more of", for example, A, B, and C means any of the following: either A, B, or C alone; or combinations of two, such as A and B, B and C, and A and C; or combinations of three A, B and C.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. An electron emitter array comprising:

a plurality of nanostructures configured in an array having a density of less than about $10^9$ nanostructures/$cm^2$, each of the plurality of nanostructures comprising a first end and a second end, wherein the first end is connected to a first electrode and the second end is positioned to emit electrons, wherein each of the plurality of nanostructures is formed of one or more of oxidation resistant metals, doped metals, metal alloys, metal oxides, doped metal oxides, and ceramics, and wherein at least one portion of each nanostructure comprises one or more barrier layer coatings disposed thereover to serve as a filter; and a second electrode in close proximity to the first electrode, wherein one or more of the plurality of nanostructures emit electrons in a gas upon application of an electric field between the first electrode and the second electrode.

2. The electron emitter array of claim 1, wherein a threshold electric field for electron emission is less than about 5.5 V/μm.

3. The electron emitter array of claim 1, wherein the plurality of nanostructures comprises one or more of a plurality of nanotubes, a plurality of nanodots, a plurality of nanocones, a plurality of nanowires, and a plurality of nanofibers.

4. The electron emitter array of claim 3, wherein the plurality of nanotubes comprises one or more of carbon nanotubes and boron nitride nanotubes.

5. The electron emitter array of claim 1, wherein the oxidation resistant metal, doped metal, and metal alloy comprise one or more elements from Groups 3, 4, 5, 6, 7, 8, 9, 10, 11, 12, 13, and 14 of the periodic table.

6. The electron emitter array of claim 1, wherein the metal oxides and doped metal oxides is selected from the group consisting of iron oxides, copper oxides, aluminum oxide, tin oxide, indium tin oxide, zinc oxide, and tungsten oxides.

7. The electron emitter array of claim 1, wherein the ceramic is selected from the group consisting of alumina, barium titanate, calcium titanate, magnesium titanate, and zinc oxide.

8. The electron emitter array of claim 1, wherein the one or more barrier layer coatings are formed of one or more materials comprising polytetrafluoroethylene (PTFE), polyglycidyl methacrylate (PGMA), polyvinylchloride, polyimide, epoxy, polyethersulphone, polyetheretherketone, polyetherimide, and polymethylmethacrylate (PMMA).

9. A charging device comprising the electron emitter array of claim 1, wherein the electron emitter array is disposed to direct charge at a receptor.

10. A charging device comprising the electron emitter array of claim 1, wherein the electron emitter array is disposed to indirectly charge a receptor.

11. A charging device comprising:

a plurality of nanostructures configured in an array having a density of less than about $10^9$ nanostructures/$cm^2$, each of the plurality of nanostructures comprising a first end and a second end, wherein the first end is connected to a first electrode and the second end is positioned to emit electrons, wherein each of the plurality of nanostructures is formed of one or more of oxidation resistant metals, doped metals, metal alloys, metal oxides, doped metal oxides, and ceramics, and wherein at least one portion of each nanostructure comprises one or more barrier layer coatings disposed thereover to serve as a filter;

a second electrode separated from the first electrode by a gap, wherein the first electrode and the second electrode are disposed in an environment comprising a gas;

a receptor positioned adjacent to the gap separating the first electrode and the second electrode;

an aperture electrode in close proximity to the gap separating the first electrode and the second electrode and positioned in between the receptor and the first electrode and the second electrode;

a first power supply to apply a voltage between the first electrode and the second electrode; and a second power supply to apply voltage between the aperture electrode and the receptor.

12. The charging device of claim 11 further comprising a plurality of nanostructures disposed over the second electrode, such that each of the plurality of nanostructures includes a first end and a second end, wherein the first end is connected to the second electrode and the second end is positioned to emit electrons, and wherein each of the plurality of nanostructures is formed of one or more of oxidation resistant metals, doped metals, metal alloys, metal oxides, doped metal oxides, and ceramics.

13. The charging device of claim 11, wherein a threshold electric field for electron emission is less than about 5.5 V/μm.

14. The charging device of claim 11, wherein the plurality of nanostructures comprises one or more of a plurality of nanotubes, a plurality of nanodots, a plurality of nanocones, a plurality of nanowires and a plurality of nanofibers.

15. The charging device of claim 14, wherein the plurality of nanotubes comprises one or more of carbon nanotubes and boron nitride nanotubes.

16. The charging device of claim 11, wherein the oxidation resistant metal, doped metal, and metal alloy comprise one or more elements from Groups 3, 4, 5, 6, 7, 8, 9, 10, 11, 12, 13, and 14 of the periodic table.

17. The charging device of claim 11, wherein the metal oxide and doped metal oxide is selected from the group consisting of iron oxides, copper oxides, aluminum oxide, tin oxide, indium tin oxide, zinc oxide, and tungsten oxides.

18. The charging device of claim 11, wherein the ceramic is selected from the group consisting of alumina, barium titanate, calcium titanate, magnesium titanate, and zinc oxide.

19. A method of charging a receptor in a charging device, the method comprising:

forming a plurality of nanostructures of one or more of oxidation resistant metals, doped metals, metal oxides, metal alloys, doped metal oxides, and ceramics over a first electrode, wherein each of the plurality of nanostructures comprises a first end and a second end, the first end being connected to a first electrode and the second end positioned to emit electrons, and further configuring the plurality of nanostructures in an array having a density of less than about $10^9$ nanostructures/$cm^2$ with at least one portion of each nanostructure comprising one or more barrier layer coatings to serve as a filter;

providing a second electrode in close proximity to the first electrode;

applying a voltage between the first electrode and the second electrode, wherein a threshold electric field for electron emission is less than about 5.5 V/μm;

supplying a gaseous material between the first electrode and the second electrode, such that an electric field on the plurality of nanostructures ionizes at least a portion of the gaseous material; and directing the ionized gaseous material towards a receptor.

20. The method of claim 19, wherein the step of forming a plurality of nanostructures comprises forming one or more of a plurality of nanotubes, a plurality of nanodots, a plurality of nanocones, a plurality of nanowires and a plurality of nanofibers.

21. A charging device comprising:

a plurality of nanostructures configured in an array having a density of less than about $10^9$ nanostructures/$cm^2$, each of the plurality of nanostructures comprising a first end and a second end, wherein the first end is connected to a first electrode and the second end positioned to emit electrons, and wherein each of the plurality of nanostructures is formed of one or more of oxidation resistant metals, doped metals, metal alloys, metal oxides, doped metal oxides, and ceramics, and wherein one or more barrier layer coatings are disposed over at least one portion of each nanostructure to serve as a filter;

a receptor positioned in close proximity to the first electrode, the receptor having a ground plane; and a first power supply to apply a voltage between the first electrode and the receptor to enable generation of a plurality of charged species in a gas that is deposited on the receptor.

22. The charging device of claim 21, wherein a threshold electric field for electron emission is less than about 5.5 V/μm.

23. The charging device of claim 21 further comprising a grid electrode disposed between the first electrode and the receptor; and a second power supply to apply a voltage between the grid electrode and the receptor.

24. The charging device of claim 21, wherein the plurality of nanostructures comprises one or more of a plurality of nanotubes, a plurality of nanodots, a plurality of nanocones, a plurality of nanowires and a plurality of nanofibers.

25. The charging device of claim 21, wherein the oxidation resistant metal, doped metal, and metal alloy comprise one or more elements from Groups 3, 4, 5, 6, 7, 8, 9, 10, 11, 12, 13, and 14 of the periodic table.

26. The charging device of claim 21, wherein the metal oxide and doped metal oxide is selected from the group consisting of iron oxides, copper oxides, zinc oxide, tin oxide, indium tin oxide, aluminum oxide, and tungsten oxides.

27. The charging device of claim 21, wherein the ceramic is selected from the group consisting of alumina, barium titanate, calcium titanate, magnesium titanate, and zinc oxide.

* * * * *